US012221767B2

(12) United States Patent
Zhao et al.

(10) Patent No.: US 12,221,767 B2
(45) Date of Patent: Feb. 11, 2025

(54) TRAVEL STABILITY SYSTEM, BACKHOE LOADER AND CONTROL METHOD

(71) Applicant: JIANGSU XCMG CONSTRUCTION MACHINERY RESEARCH INSTITUTE LTD., Suzhou (CN)

(72) Inventors: Bin Zhao, Suzhou (CN); Zhanwen Zhang, Suzhou (CN); Yanbo Geng, Suzhou (CN); Baoxiang Lang, Suzhou (CN)

(73) Assignee: JIANGSU XCMG CONSTRUCTION MACHINERY RESEARCH INSTITUTE LTD., Jiangsu (CN)

( * ) Notice: Subject to any disclaimer, the term of this patent is extended or adjusted under 35 U.S.C. 154(b) by 426 days.

(21) Appl. No.: 17/761,758

(22) PCT Filed: May 27, 2020

(86) PCT No.: PCT/CN2020/092471
§ 371 (c)(1),
(2) Date: Mar. 18, 2022

(87) PCT Pub. No.: WO2021/232455
PCT Pub. Date: Nov. 25, 2021

(65) Prior Publication Data

US 2023/0349130 A1 Nov. 2, 2023

(30) Foreign Application Priority Data

May 19, 2020 (CN) ..... 202010425641.7

(51) Int. Cl.
*E02F 9/22* (2006.01)
*E02F 9/26* (2006.01)

(52) U.S. Cl.
CPC ..... *E02F 9/2217* (2013.01); *E02F 9/2207* (2013.01); *E02F 9/2228* (2013.01); *E02F 9/262* (2013.01)

(58) Field of Classification Search
CPC ..... E02F 9/2217; E02F 9/2207; E02F 9/2228; E02F 9/262
(Continued)

(56) References Cited

U.S. PATENT DOCUMENTS 5,147,172 A 9/1992 Hosseini
6,634,653 B2 10/2003 Chatterjea
(Continued)

FOREIGN PATENT DOCUMENTS

CN 102720232 A 10/2012
CN 202595778 U 12/2012
(Continued)

OTHER PUBLICATIONS

International Search Report mailed Feb. 22, 2021 in International Application No. PCT/CN2020/092471.
(Continued)

*Primary Examiner* — Mahmoud S Ismail
(74) *Attorney, Agent, or Firm* — Venable LLP

(57) ABSTRACT

The present disclosure relates to a travel stability system, a backhoe loader and a control method. The travel stability system includes: a hydraulic actuator; a first hydraulic oil source, operatively connected with the hydraulic actuator, and configured to provide pressure oil to the hydraulic actuator; an energy storage element operatively connected with a first oil supply path between the first hydraulic oil source and the hydraulic actuator; and a controller configured to compare an oil pressure of the hydraulic actuator with an oil pressure of the energy storage element after the travel stability system is turned on, and achieve a balance
(Continued)

between the oil pressure of the energy storage element and the oil pressure of the hydraulic actuator before the energy storage element is accessed to the first oil supply path.

19 Claims, 4 Drawing Sheets

(58) Field of Classification Search
USPC ..... 701/50
See application file for complete search history.

(56) References Cited

U.S. PATENT DOCUMENTS

| | | | | |
|---|---|---|---|---|
| 7,194,856 | B2 | 3/2007 | Ma et al. | |
| 8,307,641 | B2 | 11/2012 | Hanks et al. | |
| 10,280,948 | B2 | 5/2019 | Vigholm et al. | |
| 2007/0056277 | A1 | 3/2007 | Mizoguchi et al. | |
| 2008/0086254 | A1 | 4/2008 | Anderson et al. | |
| 2016/0319516 | A1* | 11/2016 | Duppong | E02F 9/2217 |
| 2020/0277755 | A1 | 9/2020 | Kondo et al. | |
| 2020/0309166 | A1* | 10/2020 | Kawabuchi | F15B 20/002 |
| 2022/0064903 | A1* | 3/2022 | Nakajima | E02F 9/2228 |

FOREIGN PATENT DOCUMENTS

| | | | |
|---|---|---|---|
| CN | 204753689 | U | 11/2015 |
| CN | 107531123 | A | 1/2018 |
| CN | 110106937 | A | 8/2019 |
| CN | 111094665 | A | 5/2020 |
| CN | 212477899 | U | 2/2021 |
| JP | H0719203 | A | 1/1995 |
| JP | 1136375 | A | 2/1999 |
| JP | 2007186942 | A | 7/2007 |
| JP | 2017044262 | A | 3/2017 |
| KR | 19990084965 | A | 12/1999 |
| WO | 2016176547 | A1 | 11/2016 |

OTHER PUBLICATIONS

Extended European Search Report issued in EP Application No. 20936656.6 on Aug. 23, 2024.

* cited by examiner

TRAVEL STABILITY SYSTEM, BACKHOE LOADER AND CONTROL METHOD

CROSS-REFERENCE TO RELATED APPLICATIONS

The present application is a U.S. National Stage Application under 35 U.S.C. § 371 of International Patent Application No. PCT/CN2020/092471, filed on May 27, 2020, which is based on and claims priority to China Patent Application No. 202010425641.7 filed on May 19, 2020, the disclosure of both which are incorporated by reference herein in its entirety.

TECHNICAL FIELD

The present disclosure relates to the field of construction machinery, and in particular to a travel stability system, a backhoe loader and a control method.

BACKGROUND

The backhoe loader is a multi-functional construction machinery integrating excavation and loading. The backhoe loader is widely used in the construction of various basic construction projects, and can be engaged in a plurality of operations such as excavation, shovel loading, carrying, crushing and site leveling. Since it is often necessary to perform travel operation on a variety of complex and even harsh off-the-road surfaces, it is required to have a high travel speed so as to improve the operation efficiency. However, the backhoe loader is affected by the structure of the operation device at the loading end thereof. When excited by the uneven road surface, the rugged uneven road surface may cause the vibrations and bumps of the whole vehicle, which is mainly embodied as the phenomenon of back-and-forth pitching vibrations. Affected by the load of the operation device at the loading end of the front which is similar to a cantilever beam structure, the movement of the center of gravity of the whole vehicle further amplifies such vibration, thereby resulting in the occurrence of the phenomenon of more severe longitudinal pitching vibrations. On the one hand, this may lead to poor operating comfort. On the other hand, the longitudinal pitching vibrations are easily to cause spillage of the material within the hopper, thereby reducing the operation efficiency. Therefore, such vibration problem has severely restricted the development of the backhoe loader in high speed, high efficiency and safety.

In some related technologies at home and abroad, such vibration problem of the hydraulic system of the operation device is solved by the passive energy storage type travel stability system developed by using the hydro-pneumatic suspension technology, with such operation principle that an energy storage is used to effectively absorb the shock and vibration that enters the hydraulic path of the operation device such as a bucket.

SUMMARY

According to one aspect of the present disclosure, a travel stability system is provided. The travel stability system includes: a hydraulic actuator; a first hydraulic oil source, operatively connected with the hydraulic actuator, and configured to provide pressure oil to the hydraulic actuator; an energy storage element, operatively connected with a first oil supply path between the first hydraulic oil source and the hydraulic actuator; and a controller, configured to compare an oil pressure of the hydraulic actuator with an oil pressure of the energy storage element after the travel stability system is turned on, and achieve a balance between the oil pressure of the energy storage element and the oil pressure of the hydraulic actuator before the energy storage element is accessed to the first oil supply path.

In some embodiments, the travel stability system further includes: a second hydraulic oil source, operatively connected with the energy storage element, and configured to supply pressure oil to the energy storage element through a second oil supply path so as to raise the oil pressure of the energy storage element; and an oil drainage element, operatively connected with the energy storage element, and configured to unload the energy storage element through an oil drainage path so as to reduce the oil pressure of the energy storage element.

In some embodiments, the travel stability system further includes: a first pressure sensor, arranged on the energy storage element or connected to an outlet of the energy storage element, and configured to detect the oil pressure of the energy storage element; and a second pressure sensor, arranged on the hydraulic actuator or connected to an oil port of the hydraulic actuator, and configured to detect the oil pressure of the hydraulic actuator.

In some embodiments, the second hydraulic oil source includes: an oil pump, communicating with the energy storage element through the second oil supply path; and a first control valve, connected in series with the second oil supply path and signally connected with the controller, and configured to cause the second oil supply path to be in communication or be disconnected according to a control instruction of the controller.

In some embodiments, the oil drainage element includes: an oil tank, communicating with the energy storage element through the oil drainage path; and a second control valve, connected in series with the oil drainage path and signally connected with the controller, and configured to cause the oil drainage path to be in communication or be disconnected according to a control instruction of the controller.

In some embodiments, the travel stability system further includes: a third control valve, located in an oil path between the first oil supply path and the energy storage element, and signally connected with the controller, and configured to cause an oil path between the first oil supply path and the energy storage element to be in communication or be disconnected according to a control instruction of the controller.

In some embodiments, the travel stability system further includes: an electro-hydraulic proportional throttle valve, signally connected with the controller, and configured to change a throttle diameter of the electro-hydraulic proportional throttle valve according to a control instruction of the controller; and a one-way valve, connected in parallel with the electro-hydraulic proportional throttle valve, then arranged in series in the second oil supply path and configured to realize one-way communication in an oil filling direction of the energy storage element.

In some embodiments, the travel stability system further includes: a road roughness detecting element, signally connected with the controller, and configured to detect a signal characterizing a road roughness of a currently traveled road; an operation end load detecting element, signally connected with the controller, and configured to detect a current load of the hydraulic actuator; and a database, located within the controller or signally connected with the controller, and configured to store mapping data between a road roughness level and/or a load of the hydraulic actuator and the throttle diameter of the electro-hydraulic proportional throttling valve; wherein the controller is configured to determine the road roughness level according to the signal characterizing the road roughness of the currently traveled road, and query the database according to the road roughness level and/or the current load of the hydraulic actuator, and then send a control instruction to the electro-hydraulic proportional throttle valve according to a queried throttle diameter of the electro-hydraulic proportional throttle valve, so that the electro-hydraulic proportional throttle valve adjusts the throttle diameter.

In some embodiments, the travel stability system further includes: a model building unit, signally connected with the database, and configured to take different loads of the hydraulic actuator and different levels of road surface spectrum information as an input, the throttle diameter of the electro-hydraulic proportional throttle valve as an independent variable and travel smoothness as a target function to perform iterative optimization through neural network algorithms, so as to fit a set of curves of an optimal throttling diameter of the electro-hydraulic proportional throttle valve respectively corresponding to different loads of the hydraulic actuator under different road roughness levels, and save fitting data to the database.

In some embodiments, the energy storage element includes: a first energy storage, having a first maximum operation oil pressure; a second energy storage, having a second maximum operation oil pressure, wherein the second maximum operation oil pressure is greater than the first maximum operation oil pressure; a fourth control valve, connected to the second hydraulic oil source, the oil drainage element, the first energy storage and the second energy storage respectively, and configured to switch oil paths from the second hydraulic oil source to the first energy storage or the second energy storage, and switch oil paths from the first energy storage or the second energy storage to the oil drainage element.

In some embodiments, the controller is signally connected with the fourth control valve, and configured to determine whether the hydraulic actuator is in an idling condition when the travel stability system is turned on, wherein if the hydraulic actuator is in the idling condition, the controller sends a control instruction to the fourth control valve to switch the fourth control valve to cause the first energy storage to communicate with the first oil supply path via the second oil supply path; and otherwise the controller sends a control instruction to the fourth control valve to switch the fourth control valve to cause the second energy storage to communicate with the first oil supply path via the second oil supply path.

In some embodiments, an initial oil pressure of the first energy storage before the travel stability system is turned on is equal to an oil pressure of the hydraulic actuator in an idling condition, and an initial oil pressure of the second energy storage before the travel stability system is turned on is equal to an oil pressure of the hydraulic actuator in a full-load condition.

In some embodiments, the travel stability system further includes: a safety valve, arranged between the energy storage element and the oil tank, and configured to unload the energy storage element via the safety valve when the oil pressure of the energy storage element exceeds a preset maximum oil pressure.

In some embodiments, the travel stability system further includes: a speed sensor, signally connected with the controller, and configured to test a speed of a vehicle body where the travel stability system is situated; wherein the controller is configured to turn on the travel stability system when the speed of the vehicle body where the travel stability system is situated exceeds a preset speed for a preset time period, and disconnect the oil path between the first oil supply path and the energy storage element and turn off the travel stability system when the speed of the vehicle body does not meet a condition that the speed of the vehicle body exceeds the preset speed within the preset time period in a state that the travel stability system is turned on.

According to one aspect of the present disclosure, a backhoe loader is provided. The backhoe loader includes: a vehicle body; and the foregoing travel stability system.

In some embodiments, the hydraulic actuator includes a boom cylinder.

According to one aspect of the present disclosure, a control method based on the foregoing travel stability system is provided. The control method includes: comparing the oil pressure of the hydraulic actuator with the oil pressure of the energy storage element after the travel stability system is turned on; achieving a balance between the oil pressure of the energy storage element and the oil pressure of the hydraulic actuator; and accessing the energy storage element to the first oil supply path.

In some embodiments, the step of achieving a balance between the oil pressure of the energy storage element and the oil pressure of the hydraulic actuator includes: unloading the energy storage element through an oil drainage path if the oil pressure of the energy storage element is higher than the oil pressure of the hydraulic actuator, so as to reduce the oil pressure of the energy storage element to balance with the oil pressure of the hydraulic actuator; and supplying pressure oil to the energy storage element through a second oil supply path if the oil pressure of the energy storage element is lower than the oil pressure of the hydraulic actuator, so as to raise the oil pressure of the energy storage element to balance with the oil pressure of the hydraulic actuator.

In some embodiments, the travel stability system further includes: a second hydraulic oil source, an electro-hydraulic proportional throttle valve, a one-way valve and a database, wherein the second hydraulic oil source is operatively connected with the energy storage element, and configured to supply pressure oil to the energy storage element through a second oil supply path, the electro-hydraulic proportional throttle valve and the one-way valve which are connected in parallel, are then arranged in series in the second oil supply path, the one-way valve is configured to realize one-way communication in an oil filling direction of the energy storage element, and the electro-hydraulic proportional throttle valve and the database are both signally connected with the controller; the control method further including: detecting a current load of the hydraulic actuator and a signal characterizing road roughness of a current traveled road when the energy storage element is accessed to the first oil supply path; determining a road roughness level according to the signal characterizing the road roughness of the currently traveled road; querying the database according to the road roughness level and/or the current load of the hydraulic actuator; and causing the electro-hydraulic proportional throttle valve to adjust the throttle diameter according to the queried throttle diameter of the electro-hydraulic proportional throttle valve.

In some embodiments, the control method further includes: taking different loads of the hydraulic actuator and different levels of road surface spectrum information as an input, the throttle diameter of the electro-hydraulic proportional throttle valve as an independent variable and travel smoothness as a target function to perform iterative optimization through neural network algorithms, so as to fit a set of curves of an optimal throttling diameter of the electro-hydraulic proportional throttle valve respectively corresponding to different loads of the hydraulic actuator under different road roughness levels, and save fitting data to the database.

In some embodiments, the energy storage element includes: a first energy storage, a second energy storage, and a fourth control valve, wherein a first maximum operation oil pressure of the first energy storage is less than a second maximum operation oil pressure of the second energy storage; the control method further includes: determining whether the hydraulic actuator is in an idling condition when the travel stability system is turned on; switching the fourth control valve to cause the first energy storage to communicate with the first oil supply path if the hydraulic actuator is in the idling condition; and switching the fourth control valve to cause the second energy storage to communicate with the first oil supply path if the hydraulic actuator is in a loaded condition.

In some embodiments, the control method further includes: turning on the travel stability system when a time period during which a speed of the vehicle body where the travel stability system is situated exceeds a preset speed for a preset time period in a state that the travel stability system is not turned on; and disconnecting the oil path between the first fuel supply path and the energy storage element and turning off the travel stability system when the speed of the vehicle body does not meet a condition that the speed of the vehicle body exceeds the preset speed within the preset time period in a state that the travel stability system is turned on.

BRIEF DESCRIPTION OF THE ACCOMPANYING DRAWINGS

The accompanying drawings which constitute part of this specification, illustrate the exemplary embodiments of the present disclosure, and together with this specification, serve to explain the principles of the present disclosure.

The present disclosure may be more explicitly understood from the following detailed description with reference to the accompanying drawings, in which.

Figure 1:
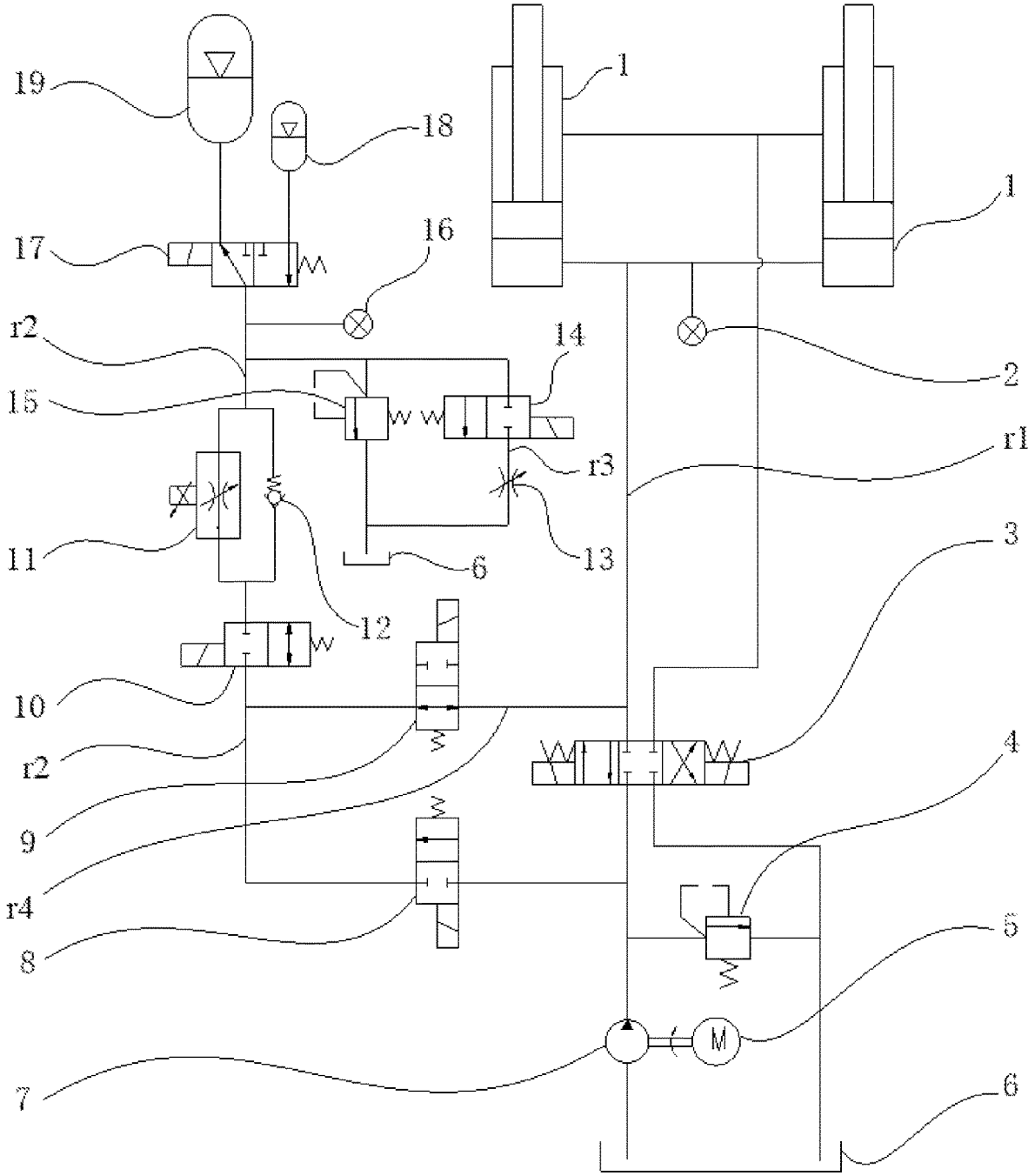
FIG. 1 is a schematic view of hydraulic principles in some embodiments of the travel stability system according to the present disclosure.

It should be understood that the dimensions of various parts shown in the accompanying drawings are not drawn according to actual proportional relations. In addition, the same or similar components are denoted by the same or similar reference signs.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (including technical and scientific terms) used in the present disclosure have the same meanings as understood by those skilled in the art of the present disclosure unless otherwise defined. It should also be understood that terms as defined in general dictionaries, unless explicitly defined herein, should be interpreted as having meanings that are in line with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

In some related technologies, the passive energy storage type travel stability system developed by the hydro-pneumatic suspension technology is used to solve the vibration problem. After studies, it has been found that, when the passive energy storage type travel stability system is turned on, since the pressure of the energy storage is not necessarily balanced with the pressure of the rodless cavity of the boom hydraulic cylinder in the operation device after the system is turned on, it is easily to cause the piston rod of the boom cylinder to move back and forth, so that the operation device cannot always remain in a set position but change in position, thereby resulting in spillage of the material in the bucket or other safety risks.

The setting position here refers to a specific position where the operation device may remain (for example, an open end of the bucket remains horizontal, and the distance from the connection hinge point of the bucket to the ground is about 300 mm) when the construction machinery such as a backhoe loader capable of performing transfer or operation by carrying the material travels and performs a transfer operation by carrying the material, so that the whole vehicle has a low center of gravity, thereby improving the stable operation and smooth travel of the vehicle.

In addition, due to the differences in the road roughness and the weight of the material in the bucket, the damping required for vibration reduction also varies, so that the passive energy storage type travel stability system in the related art is difficult to adjust the damping of the system in real time according to the road roughness and the weight of the material in the bucket.

In view of this, the present disclosure provides a travel stability system, a backhoe loader, and a control method, which can improve the safety during the travelling process.

Figure 2:
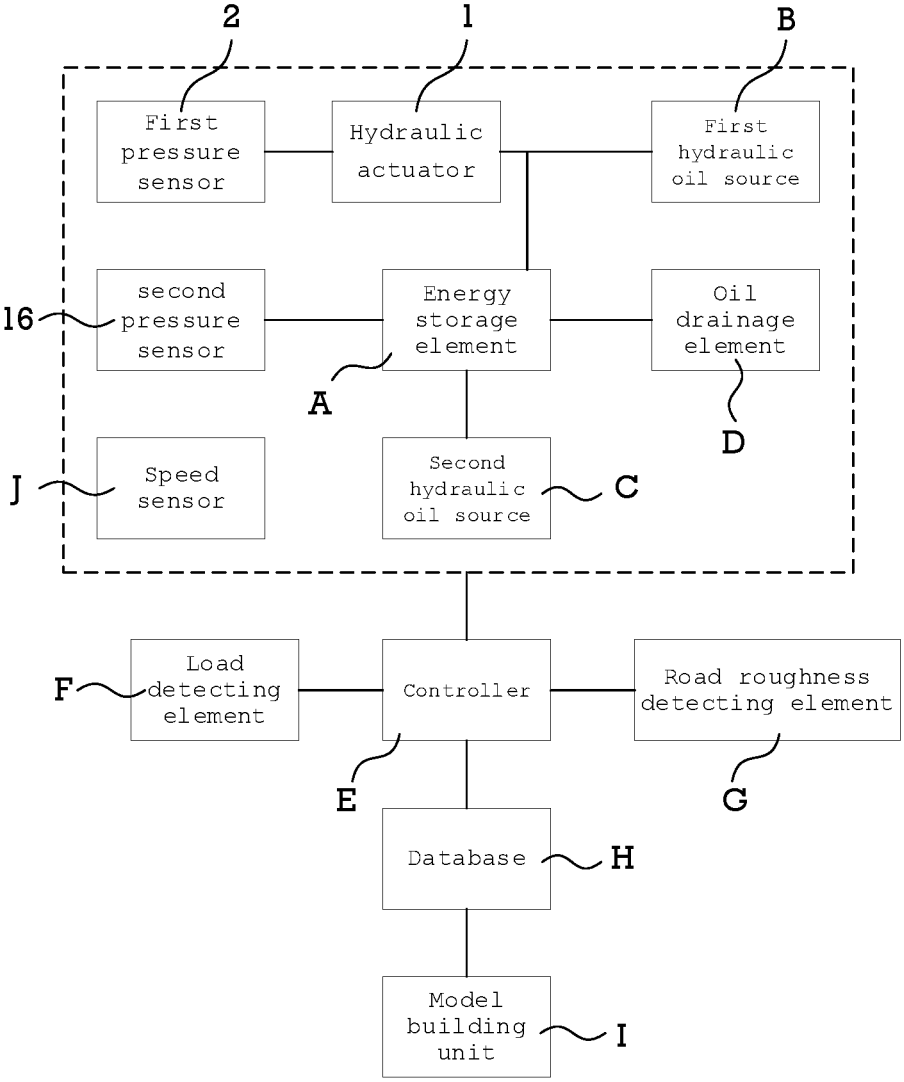
FIG. 2 is a schematic block diagram in some embodiments of the travel stability system according to the present disclosure.

As shown in FIG. 1, it is a schematic view of hydraulic principles in some embodiments of the travel stability system according to the present disclosure. FIG. 2 is a schematic block diagram in some embodiments of the travel stability system according to the present disclosure. Referring to FIGS. 1 and 2, in some embodiments, the travel stability system includes: a hydraulic actuator 1, a first hydraulic oil source B, an energy storage element A, and a controller E. The hydraulic actuator 1 may be an operation unit of the operation vehicle to which the travel stability system is applied. In some embodiments, the hydraulic actuator 1 can carry the material when the construction machinery vehicle travels. For example, in the backhoe loader where the embodiment of the travel stability system of the present disclosure is used, the hydraulic actuator 1 may be a boom cylinder.

The first hydraulic oil source B is operatively connected with the hydraulic actuator 1 and configured to provide pressure oil to the hydraulic actuator 1. The first hydraulic oil source B may provide hydraulic oil to the hydraulic actuator 1 through the first oil supply path r1 as necessary, and stop the supply of hydraulic oil to the hydraulic actuator 1 as necessary.

Referring to FIG. 1, in some embodiments, the first hydraulic oil source B includes a hydraulic source, for example the oil pump 7 in FIG. 1. In some embodiments, the first hydraulic oil source B may further include an electromagnetic change valve 3 provided in the first oil supply path r1 to realize the operability of oil supply. The first hydraulic oil source B may also include an overflow valve 4 arranged between the first oil supply path r1 and the oil return oil path to provide overload protection of the system or realize functions such as constant pressure of the hydraulic source.

In FIG. 1, the oil pump 7 may be driven by the electric motor 5 or the engine to pump hydraulic oil from the oil tank 6. The oil inlet and the oil return port of the electromagnetic change valve 3 are respectively connected to the outlet of the oil pump 7 and the oil tank 6, and the two operation oil ports of the electromagnetic change valve 3 are respectively connected to the rodless cavities of the two hydraulic actuators 1, so as to realize start and stop of the hydraulic actuator 1 as well as operations in different running directions by the switching of the electromagnetic change valve 3. In other embodiments, the first hydraulic oil source B may also use an oil supply mechanism configured to drive own operation units in an existing operation machine.

The energy storage element A is operatively connected with the first oil supply path r1 between the first hydraulic oil source B and the hydraulic actuator 1. The energy storage element A may include one or more energy storages, such as a gas-type energy storage, a spring-type energy storage or a piston-type energy storage. The energy storage element A can effectively absorb the shock and vibration in the associated hydraulic path of the hydraulic actuator 1, thereby effectively solving the problems such as permeation of the oil in the hydraulic pipeline fitting, severe vibration of the operator cabin and the vehicle body structure, and easy spillage of the carried material in some operation vehicles where the travel stability system is applied, and improving the reliability, operation comfort, travel stability and operation efficiency of the operation vehicle.

Referring to FIG. 2, in some embodiments, the controller E can compare the oil pressures of the hydraulic actuator 1 with the energy storage element A after the travel stability system is turned on, and achieve a balance between the oil pressures of the energy storage element A and the hydraulic actuator 1 before the energy storage element A is accessed to the first oil supply path r1. In this embodiment, the pressure of the energy storage element is adjusted so that it remains consist with the pressure of the hydraulic actuator to ensure that after the travel stability system is turned on, the operation device may still remain at the set position before the system is turned on, thereby improving the stable operation and smooth travel of the operation vehicle.

The controller E may be an electronic controller that operates in a logical manner to perform operations, execute control algorithms, store and query data, and other required operations. The controller E may include or is capable of accessing a memory, an auxiliary storage device, a processor, and any other assembly for running an application program. The memory and the auxiliary storage device may be in the form of read only memory (ROM), random access memory (RAM), or an integrated path that may be accessed by the controller. Various other paths (such as power supply paths, signal conditioning paths, driver paths, and other types of paths) may be associated with the controller E.

Referring to FIGS. 1 and 2, in some embodiments, the travel stability system further includes: a second hydraulic oil source C and an oil drainage element D. The second hydraulic oil source C is operatively connected with the energy storage element A, and can supply pressure oil to the energy storage element A through the second oil supply path r2, so as to raise the oil pressure of the energy storage element A. For example, when the pressure of the energy storage element A is lower than that of the hydraulic actuator 1, the second hydraulic oil source C supplies the pressure oil to the energy storage element A so that the oil pressure of the energy storage element A is raised and tends to be in consistence with the pressure of the hydraulic actuator 1.

In FIG. 1, the second hydraulic oil source C includes: an oil pump 7 and a first control valve 8. The oil pump 7 communicates with the energy storage element A through the second oil supply oil path r2. The first control valve 8 which is connected in series with the second oil supply oil path r2, and signally connected with the controller E, is configured to cause the second oil supply oil path r2 to be in communication or be disconnected according to a control instruction of the controller E. In some embodiments, the first hydraulic oil source B and the second hydraulic oil source C use the same oil pump to provide hydraulic oil. In other embodiments, the first hydraulic oil source B and the second hydraulic oil source C use different oil pumps to provide hydraulic oil.

The oil drainage element D is operatively connected with the energy storage element A, and configured to unload the energy storage element A through the oil drainage path r3 so as to reduce the oil pressure of the energy storage element A. For example, when the pressure of the energy storage element A is higher than that of the hydraulic actuator 1, the energy storage element A can be unloaded by the oil drainage element D, so that the oil pressure of the energy storage element A is reduced, and tends to be in consistence with the pressure of the hydraulic actuator 1.

In FIG. 1, the oil drainage element D includes an oil tank 6 and a second control valve 14. The oil tank 6 communicates with the energy storage element A through the oil drainage path r3. The second control valve 14 is connected in series with the oil drainage path r3 and signally connected with the controller E, and configured to cause the oil drainage path r3 to be in communication or be disconnected according to a control instruction of the controller E.

In order to effectively obtain the pressures of the energy storage element A and the hydraulic actuator 1, referring to FIGS. 1 and 2, in some embodiments, the travel stability system further includes a first pressure sensor 2 and a second pressure sensor 16. The first pressure sensor 2 may be arranged on the energy storage element A or connected to the outlet of the energy storage element A. The first pressure sensor 2 is configured to detect the oil pressure of the energy storage element A. The second pressure sensor 16 may be arranged on the hydraulic actuator 1 or connected to the oil port of the hydraulic actuator 1. The second pressure sensor 16 is configured to detect the oil pressure of the hydraulic actuator 1.

Referring to FIG. 1, in some embodiments, the travel stability system further includes a third control valve 9. The third control valve 9 is located in the oil path between the first oil supply path r1 and the energy storage element A, and signally connected with the controller E. The third control valve 9 can cause an oil path between the first oil supply path r1 and the energy storage element A to be in communication or be disconnected according to a control instruction of the controller E. In FIG. 1, the third control valve 9 may be located in the oil path r4 that communicates the first oil supply path r1 with the second oil supply path r2. Before the energy storage element A is accessed to the first oil supply path r1, the oil path between the energy storage element A and the first oil supply path r1 is disconnected through the third control valve 9. After the pressure of the energy storage element A is in consistence with that of the hydraulic actuator 1 through the second hydraulic oil source C or the oil drainage element D, the third control valve 9 is turned on, so that the energy storage element A is communicated with the first oil supply path r1, thereby providing protection against shock and vibration to the hydraulic actuator 1 through the energy storage element A.

The road roughness on which the operation vehicle travels may change with the travel process. For example, the operation environment of the backhoe loader is generally a non-pavement off-road surface. In order to reduce the effect of the variation in the road roughness of the road on the comfort of the driver and the smooth travel, referring to FIG. 1, in some embodiments, the travel stability system further includes: an electro-hydraulic proportional throttle valve 11 and a one-way valve 12. The electro-hydraulic proportional throttle valve 11 is signally connected with the controller E, and configured to change the throttle diameter of the electro-hydraulic proportional throttle valve 11 according to a control instruction of the controller E. The one-way valve 12 after connection with the electro-hydraulic proportional throttle valve 11 in parallel, is arranged in series with the second oil supply path r2, and configured to realize one-way communication in an oil filling direction of the energy storage element A.

In this embodiment, the electro-hydraulic proportional throttle valve 11 and the one-way valve 12 can constitute a one-way throttle valve configured to control the flow of the pressure oil between the energy storage element A and the first oil supply path r1, while the throttle diameter of the electro-hydraulic proportional throttle valve 11 is adjusted by controlling the current so that the damping of the system can be changed.

Regarding the adjustment of the throttle diameter of the electro-hydraulic proportional throttle valve 11, referring to FIG. 2, in some embodiments, the travel stability system further includes: a road roughness detecting element G, an operation end load detecting element F and a database H. The road roughness detecting element G may include an acceleration sensor or an inclination sensor arranged on the vehicle body, and is signally connected with the controller E. The road roughness detecting element G may be configured to detect a signal characterizing the road roughness of the currently traveled road. The road roughness refers to the degree of deviation of the road from the reference plane, which may be characterized by wavelength and amplitude.

The operation end load detecting element F may use a load sensor to weigh the weight of the material carried by the operation end as the current load of the hydraulic actuator. The operation end load detecting element F is signally connected with the controller E, and configured to detect the current load of the hydraulic actuator 1. The database H is located within the controller E or signally connected with the controller E, and configured to store the road roughness level and/or the mapping data between the load of the hydraulic actuator and the throttle orifice diameter of the electro-hydraulic proportional throttle valve 11.

The controller E can determine the road roughness level according to the signal characterizing the road roughness of the currently traveled road, and query the database H according to the road roughness level and/or the current load of the hydraulic actuator 1, and then send a control instruction to the electro-hydraulic proportional throttle valve 11 according to the queried throttle diameter of the electro-hydraulic proportional throttle valve 11, so that the electro-hydraulic proportional throttle valve 11 adjusts the throttle diameter.

The mapping data stored within the database may be calculated in advance according to a simulation model. Correspondingly, in some embodiments, the travel stability system further includes a model building unit I. The model building unit I is signally connected with the database H, and configured to take different loads of the hydraulic actuator and different levels of road surface spectrum information as an input, the throttle diameter of the electro-hydraulic proportional throttle valve 11 as an independent variable and travel smoothness as a target function to perform iterative optimization through neural network algorithms, so as to fit a set of curves of an optimal throttling diameter of the electro-hydraulic proportional throttle valve 11 respectively corresponding to different loads of the hydraulic actuator under different road roughness levels, and save fitting data to the database H.

When a model is built, it is possible to build simulation models corresponding to a plurality of road surface levels, to input the values of a plurality of throttle diameters are input for different hydraulic brake loads in the simulation model of each road level, and find out a set of curves of the optimal throttle diameter corresponding to the best travel smoothness under different loads. The curve may include a curve of the optimal throttle diameter during that the hydraulic brake is in idling.

In this way, when the energy storage element A is accessed to the first oil supply path r1, the controller may detect the current load of the hydraulic actuator 1 and the signal characterizing the road roughness of the currently traveled road, and determine the road roughness level according to the signal characterizing the road roughness of the currently traveled road. The controller may further query the database H according to the road roughness level and/or the current load of the hydraulic actuator 1, and cause the electro-hydraulic proportional throttle valve 11 to adjust the throttle diameter according to the queried throttle diameter of the electro-hydraulic proportional throttle valve 11.

The road roughness level here represents a certain range of road roughness. After the travel stability system is turned on, the road roughness detecting element G may monitor the road roughness in real time. When the road roughness is within a range corresponding to a certain road roughness level, there is no need to adjust the throttle diameter of the electro-hydraulic proportional throttle valve 11. When it is detected that the road roughness level where the current road roughness is situated changes, the corresponding throttle diameter is adjusted according to the level of the current road roughness. The optimal throttle diameter stored within the database is used to reduce the adverse effects of vibration and impact on the operation vehicle during the traveling process, and improve the comfort of the driver and the travel smoothness.

For the operation vehicle, the loads of the operation end under idling and full-load conditions are greatly distinctive, so that there is a certain difference in the demand for vibration reduction. In order to cause the operation vehicle to have a favorable vibration reduction effect in these two conditions, referring to FIG. 1, in some embodiments, the energy storage element A includes: a first energy storage 18, a second energy storage 19 and a fourth control valve 17. The first energy storage 18 has a first maximum operation oil pressure, the second energy storage 19 has a second maximum operation oil pressure, wherein the second maximum operation oil pressure is greater than the first maximum operation oil pressure. The first energy storage 18 is equivalent to a low-pressure energy storage and is mainly applied in an idling state, while the second energy storage 19 is equivalent to a high-pressure energy storage and is mainly applied in a loaded state.

The fourth control valve 17 is connected to the second hydraulic oil source C, the oil drainage element D, the first energy storage 18 and the second energy storage 19 respectively. The fourth control valve 17 can switch the oil paths from the second hydraulic oil source C to the first energy storage 18 or the second energy storage 19, and switch the oil paths from the first energy storage 18 or the second energy storage 19 to the oil drainage element D. The fourth control valve 17 may implement switching the operations of pressurizing and unloading of any one of the first energy storage 18 and the second energy storage 19 and the buffering of the hydraulic actuator.

In some embodiments, the controller E is signally connected with the fourth control valve 17. The controller E can determine whether the hydraulic actuator 1 is in an idling condition when the travel stability system is turned on. If it is in the idling condition, the controller E sends a control instruction to the fourth control valve 17 to switch it to cause the first energy storage 18 to be connected with the first oil supply path r1 via the second oil supply path r2, and otherwise, sends a control instruction to the fourth control valve 17 to switch it to cause the second energy storage 19 to be connected with the first supply oil path r1 via the second oil supply path r2.

In some embodiments, the initial oil pressure of the first energy storage 18 before the travel stability system is turned on is equal to the oil pressure of the hydraulic actuator 1 in an idling condition, so that it is possible to save the time consumed in balancing the pressures of the energy storage 18 and the hydraulic actuator 1, raise the response speed of the system and improve the sensitivity in reaction. Moreover, the rigidity and damping of the first energy storage 18 are relatively small, so that it is possible to provide a better damping effect to the hydraulic actuator for an idling condition.

In some embodiments, the initial oil pressure of the second energy storage 19 before the travel stability system is turned on is equal to the oil pressure of the hydraulic actuator 1 in a full-load condition. Since the second energy storage 19 has a relatively large air inflation pressure and volume, it is possible to meet the vibration reduction requirements in a loaded or even full-load condition. For some operation vehicles, full-load operation is usually used. The initial oil pressure of the second energy storage 19 is equal to the oil pressure of the hydraulic actuator 1 in a full-load condition, so that it is possible to reduce the time consumed in balancing the pressures of the second energy storage 19 and the hydraulic actuator 1, raise the response speed of the system and improve the sensitivity in reaction.

In the above-described embodiments, each control valve may be an electromagnetic switching valve, or a hydraulic control switching valve, an electro-hydraulic switching valve, and the like.

Referring to FIG. 1, in some embodiments, the travel stability system further includes: a safety valve 15 located between the energy storage element A and the oil tank 6. The safety valve 15 can unload the energy storage element A via the safety valve 15 when the oil pressure of the energy storage element A exceeds a preset maximum oil pressure. When the road surface is excessively excited, it is possible to exceed the maximum load-bearing capacity of the energy storage element. At this time, the oil may flow into the oil tank 6 through the safety valve 15 so as to achieve overload protection of the energy storage element and its pipeline. In FIG. 1, the second oil supply line may also be connected in series with an electromagnetic on-off valve 10. The electromagnetic on-off valve 10 may be configured to cause the energy storage element A to be connected or disconnected with the first oil supply path r1 and the second oil supply path r2.

Take into account that in some operation conditions (for example, the shovel loading and unloading operations of the backhoe loader), the travel time is very short and the vehicle speed also varies relatively frequently, so that there is no need to use the travel stability system. Therefore, referring to FIG. 2, in some embodiments, the travel stability system further includes: a speed sensor J. The speed sensor J is signally connected with the controller E, and configured to test the speed of the vehicle body K where the travel stability system is situated. The controller E can turn on the travel stability system when the speed of the vehicle body where the travel stability system is situated exceeds a preset speed (for example, 5 KM/h or the like) for a preset time period (for example, 10s). In the state that the travel stability system is turned on, the controller E can turn off the travel stability system so as to save the recourses of the system when the speed of the vehicle body does not meet the condition that the speed of the vehicle body exceeds the preset speed within a preset time period.

Figure 3:
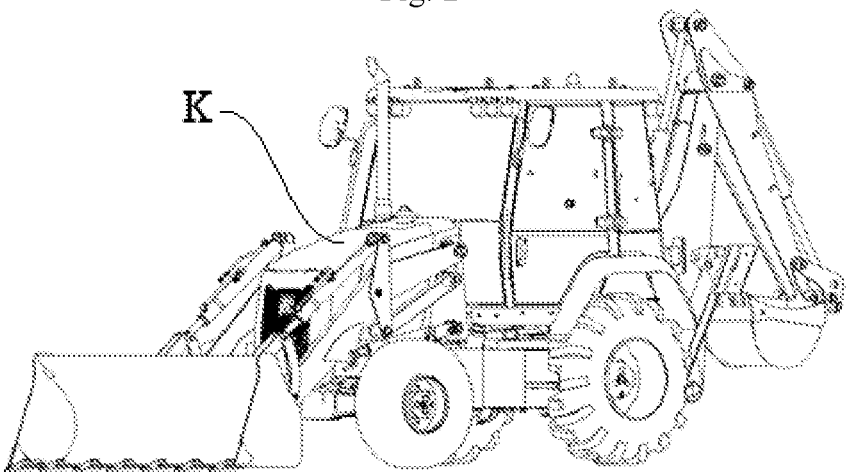
FIG. 3 is a schematic structural diagram in some embodiments of the backhoe loader according to the present disclosure.

The above-described travel stability system may be applied to various operation vehicles, such as a backhoe loader, a loader, a skid steer loader and a fork loaders. As shown in FIG. 3, it is a schematic structural diagram in some embodiments of the backhoe loader according to the present disclosure. In FIG. 3, the backhoe loader includes a vehicle body K and any of the above-described embodiments of the travel stability system. In some embodiments, the hydraulic actuator 1 may include a boom cylinder of the backhoe loader. The boom cylinder is connected with a loading mechanism (for example, a bucket) and may be configured to lift the material.

Figure 4:
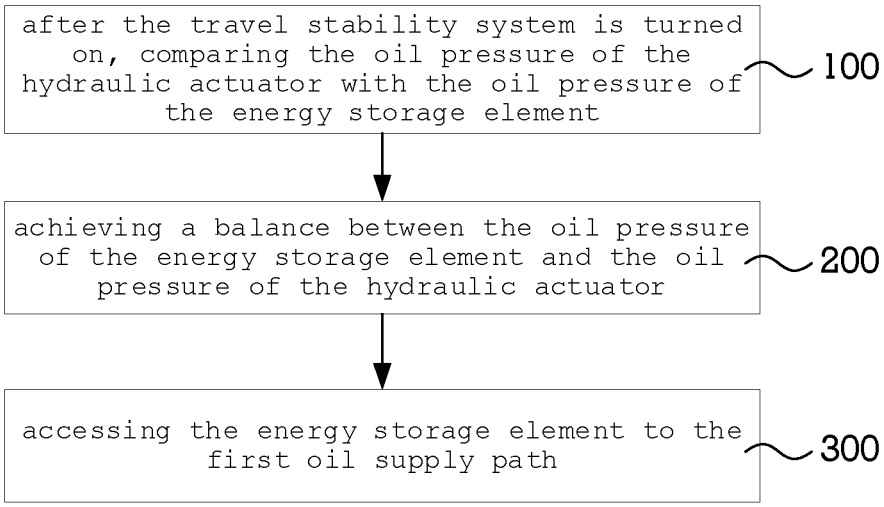
FIG. 4 is a schematic flowchart in some embodiments of the control method according to the present disclosure.

Based on the above-described embodiments of the travel stability system, the present disclosure also provides a control method of the system. As shown in FIG. 4, it is a schematic flowchart in some embodiments of the control method according to the present disclosure. Referring to FIG. 4, in some embodiments, the control method includes:

Step 100: after the travel stability system is turned on, comparing the oil pressure of the hydraulic actuator 1 with the oil pressure of the energy storage element A;

Step 200: achieving a balance between the oil pressure of the energy storage element A and the oil pressure of the hydraulic actuator 1;

Step 300: accessing the energy storage element A to the first oil supply path r1.

In this embodiment, the above-described steps may be implemented by the controller E in the travel stability system. In this embodiment, the pressure of the energy storage element is adjusted to cause it to remain in consistence with the pressure of the hydraulic actuator, so as to ensure that after the travel stability system is turned on, the operation device can still remain at the set position before the system is turned on without change or a significant change, thereby improving the handling stability and travel smooth of the operation vehicle.

In some embodiments, the step 200 may include: if the oil pressure of the energy storage element A is higher than that of the hydraulic actuator 1, the energy storage element A is unloaded through the oil drainage path r3, so as to reduce the oil pressure of the energy storage element A to balance with the oil pressure of the hydraulic actuator 1. If the oil pressure of the energy storage element A is lower than that of the hydraulic actuator 1, the pressure oil is supplied to the energy storage element A through the second oil supply path r2, so as to raise the oil pressure of the energy storage element A to balance with the oil pressure of the hydraulic actuator 1.

Referring to FIGS. 1 and 2, in some embodiments, the travel stability system further includes: a second hydraulic oil source C, an electro-hydraulic proportional throttle valve 11, a one-way valve 12, and a database H. The second hydraulic oil source C is operatively connected with the energy storage element A, and configured to supply the pressure oil to the energy storage element A through the second oil supply path r2. The electro-hydraulic proportional throttle valve 11 and the one-way valve 12 which are connected in parallel, are arranged in series in the second oil supply path r2. The one-way valve 12 is configured to realize one-way communication in an oil filling direction of the energy storage element A, and the electro-hydraulic proportional throttle valve 11 and the database H are both signally connected with the controller E.

Figure 5:
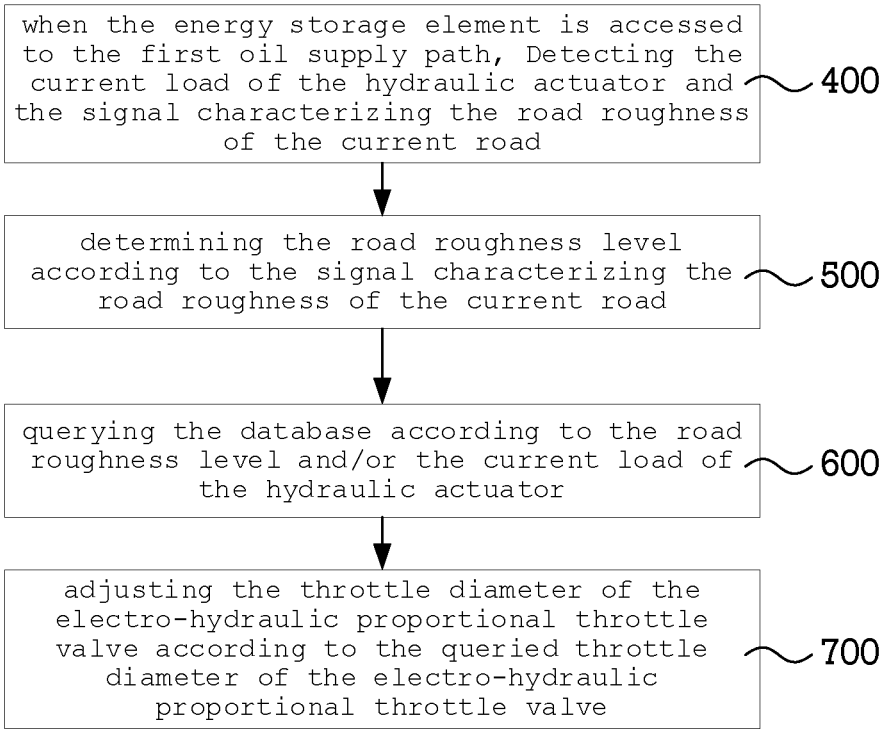
FIG. 5 is a schematic flow chart of automatic adjustment of the throttle diameter in some embodiments of the control method according to the present disclosure.

Referring to FIG. 5, correspondingly, the control method further includes steps 400 to 700 for realizing automatic adjustment of the throttle diameter of the electro-hydraulic proportional throttle valve 11. In step 400, when the energy storage element A is accessed to the first oil supply path r1, the current load of the hydraulic actuator 1 and the signal characterizing the road roughness of the current road are detected. In step 500, the road roughness level is determined according to the signal characterizing the road roughness of the current road. In step 600, the database H is queried according to the road roughness level and/or the current load of the hydraulic actuator 1. In step 700, the throttle diameter of the electro-hydraulic proportional throttle valve 11 is adjusted according to the queried throttle diameter of the electro-hydraulic proportional throttle valve 11.

In some embodiments, the control method may further include: taking different loads of the hydraulic actuator and different levels of road surface spectrum information as an input, the throttle diameter of the electro-hydraulic proportional throttle valve 11 as an independent variable and travel smoothness as a target function to perform iterative optimization through neural network algorithms, so as to fit a set of curves of an optimal throttling diameter of the electro-hydraulic proportional throttle valve (11) respectively corresponding to different loads of the hydraulic actuator under different road roughness levels, and save fitting data to the database H.

Referring to FIG. 1, in some embodiments, the energy storage element A includes: a first energy storage 18, a second energy storage 19, and a fourth control valve 17. The first maximum operation oil pressure of the first energy storage 18 is lower than the second maximum operation oil pressure of the second energy storage 19. Correspondingly, the control method may further include: determining whether the hydraulic actuator 1 is in an idling condition when the travel stability system is turned on; switching the fourth control valve 17 to cause the first energy storage 18 to communicate with the first oil supply path r1 if the hydraulic actuator 1 is in the idling condition; and switching the fourth control valve 17 to cause the second energy storage 19 to communicate with the first oil supply oil path r1 if the hydraulic actuator 1 is in a loaded condition.

In some embodiments, the control method further includes: turning on the travel stability system when a time period during which the speed of the vehicle body K where the travel stability system is situated remains in exceeding a first preset value for a first time period in the state that the travel stability system is not turned on; and turning off the travel stability system when a time period during which the speed of the vehicle body K remains in not exceeding a second preset value for a second time period in the state that the travel stability system is turned on.

Figure 6:
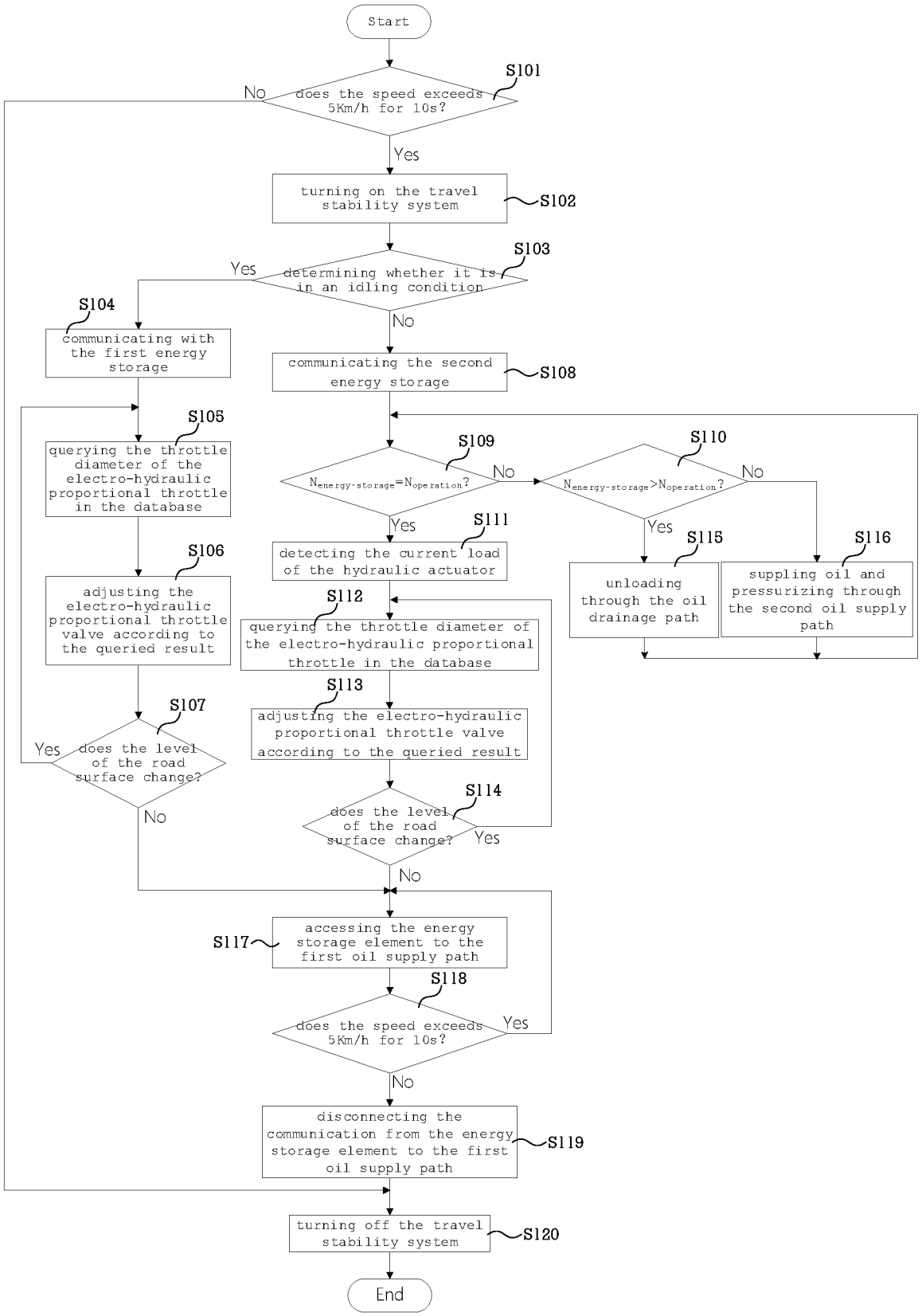
FIG. 6 is a schematic flow chart of the control in some embodiments of the travel stability system according to the present disclosure.

Next, the control process of an example of the travel stability system applied to the backhoe loader in FIG. 6 will be described in conjunction with FIGS. 1 to 3.

In step S101, when the backhoe loader performs a load operation in a short-to-medium distance or an idling travel in a high speed, the controller may determine whether the speed of the vehicle body meets the condition that the speed of the vehicle body exceeds the limit value of 5 Km/h for a time period of more than 10 seconds according to the speed signal returned by the speed sensor located in the wheel assembly. If meeting the condition, step S102 is performed, that is, the travel stability system is turned on by the controller. If not meeting the condition, step S120 is performed, and the travel stability system is not turned on or is turned off.

The driver may operate the handle to energize the left or right position of the three-position four-way electromagnetic change valve 3 to fill the boom cylinder with oil through the oil pump 7, thereby controlling the boom cylinder 1 to perform a telescopic action so as to complete the shovel loading operation. In addition, the travel stability system may be set to a manual on-off mode, such that the controller receives a control instruction of the driver through the control panel to realize the turn-on or turn-off of the travel stability system, thereby preventing failure of the automatic mode and improving the safety of the system.

After step S102, in step S103, whether it is in an idling condition is determined by a load sensor mounted at the bottom of the bucket. If it is in an idling condition, step S104 is performed. In step S104, the fourth control valve 17 is selected to communicate with the first energy storage 18. Since the initial pressure of the first energy storage 18 is set to be the same as the pressure of the rodless cavity of the boom cylinder during idling, the balance between the pressures of the first energy storage 18 and the pressure of the rodless cavity of the boom cylinder is achieved, without variation in the position of the operation device after the connection.

Subsequently, in step S105, the signal of the road roughness is collected in real time by the acceleration sensor mounted at the position of the axle, and is fed back to the controller so as to further determine the level of the current road roughness. According to the road roughness level, the database is queried for a value of the throttle diameter of the electro-hydraulic proportional throttle corresponding to the level of the current road roughness in an idling condition.

Next, in step S106, the controller adjusts the throttle diameter of the electro-hydraulic proportional throttle valve 11 according to the queried result. If the level of the road surface does not change in step S107, step S117 is performed such that the electromagnetic on-off valve 10 is energized and turned on, and the third control valve 9 is switched from a turn-off state to a turn-on state to maintain the smoothness of the oil path r4, thereby forming a hydraulic passage from the first energy storage 18 to the rodless cavity of the boom cylinder via the fourth control valve 17, the electro-hydraulic proportional throttle valve 11, the electromagnetic on-off valve 10 and the third control valve 9. If the level of the road surface changes, step S105 is returned to determine the value of the throttle diameter of the alternative electro-hydraulic proportional throttle valve again.

When it is determined not in an idling condition in step S103, that is, in a loaded operation condition, step S108 is performed. In step S108, the fourth control valve 17 is selected to communicate with the second energy storage 19. Then, step S109 is performed to determine whether the pressure $N_{energy\text{-}storage}$ of the second energy storage 19 is equal to the pressure $N_{operation}$ of the boom cylinder at the operation end. If $N_{energy\text{-}storage}$ is not equal to $N_{operation}$, step S110 is performed to determine whether the pressure $N_{energy\text{-}storage}$ of the second energy storage 19 is greater than the pressure $N_{operation}$ of the boom cylinder at the operation end. If $N_{energy\text{-}storage}>N_{operation}$, step S115 is performed such that the oil fluid of the second energy storage 19 flows back to the oil tank 6 via the fourth control valve 17, the second control valve 14 and the throttle valve 13 through the oil drainage path, so as to realize the unloading operation. If $N_{energy\text{-}storage}<N_{operation}$, the second energy storage 19 is supplemented with oil through the second oil supply path so as to realize the pressurization operation. During the pressurization, the pressure oil pumped by the oil pump 7 flows into the second energy storage 19 via the first control valve 8, the electromagnetic on-off valve 10, the one-way valve 12 and the fourth control valve 17.

After the steps S115 and S116, both return to perform the step S108 again. After one or more cycles, step S109 is performed until the pressure $N_{energy\text{-}storage}$ of the second energy storage 19 is equal to the pressure $N_{operation}$ of the boom cylinder at the operation end.

If the pressure $N_{energy\text{-}storage}$ of the second energy storage 19 is equal to the pressure $N_{operation}$ of the boom cylinder at the operation end, step S111 is performed. For example, if the initial oil pressure of the second energy storage 19 before the travel stability system is turned on is equal to the oil pressure of the hydraulic actuator 1 in a full-load condition, then step S111 may be performed directly after the determination in the step S108 in a full-load state.

In step S111, the current load of the hydraulic actuator is detected. Such operation may also be performed before the step of determining whether it is in the idling state. According to the current load and the road roughness level corresponding to the signal of the road roughness, the database is queried in step S112, and then the operation of adjusting the electro-hydraulic proportional throttle is performed according to the queried value of the throttle diameter of the electro-hydraulic proportional throttle in step S113.

If the level of the road surface in step S114 does not change, step S117 is performed so that the electromagnetic on-off valve 10 is energized and turned on, and the third control valve 9 is switched from an turn-off state to an turn-on state so as to maintain the smoothness of the oil path r4, thereby forming a hydraulic passage from the second energy storage 19 to the rodless cavity of the boom cylinder via the fourth control valve 17, the electro-hydraulic proportional throttle valve 11, the electromagnetic on-off valve 10 and the third control valve 9. If the level of the road surface changes, step S112 is returned to determine the value of the throttle diameter of the alternative electro-hydraulic proportional throttle valve again.

After step S117, if the speed of the vehicle body K does not meet the condition of remaining in exceeding 5 Km/h within 10s, step S119 may be performed to disconnect the communication oil path between the energy storage element and the first oil supply path, and further turn off the travel stability system through step S120.

Hereto, various embodiments of the present disclosure have been described in detail. Some details well known in the art are not described in order to avoid obscuring the concept of the present disclosure. According to the above description, those skilled in the art would fully understand how to implement the technical solutions disclosed here.

Although some specific embodiments of the present disclosure have been described in detail by way of examples, those skilled in the art should understand that the above examples are only for the purpose of illustration but not for limiting the scope of the present disclosure. It should be understood by those skilled in the art that modifications to the above embodiments and equivalently substitution of part of the technical features may be made without departing from the scope and spirit of the present disclosure. The scope of the present disclosure is defined by the appended claims.

What is claimed is:

1. A travel stability system, comprising:

a hydraulic actuator;

a first hydraulic oil source, operatively connected with the hydraulic actuator, and configured to provide pressure oil to the hydraulic actuator;

an energy storage element, operatively connected with a first oil supply path between the first hydraulic oil source and the hydraulic actuator;

a controller, configured to compare an oil pressure of the hydraulic actuator with an oil pressure of the energy storage element after the travel stability system is turned on, and achieve a balance between the oil pressure of the energy storage element and the oil pressure of the hydraulic actuator before the energy storage element is accessed to the first oil supply path;

a second hydraulic oil source, operatively connected with the energy storage element, and configured to supply pressure oil to the energy storage element through a second oil supply path so as to raise the oil pressure of the energy storage element; and an oil drainage element, operatively connected with the energy storage element, and configured to unload the energy storage element through an oil drainage path so as to reduce the oil pressure of the energy storage element.

2. The travel stability system according to claim 1, further comprising:

a first pressure sensor, arranged on the energy storage element or connected to an outlet of the energy storage element, and configured to detect the oil pressure of the energy storage element; and a second pressure sensor, arranged on the hydraulic actuator or connected to an oil port of the hydraulic actuator, and configured to detect the oil pressure of the hydraulic actuator.

3. The travel stability system according to claim 1, wherein the second hydraulic oil source comprises:

an oil pump, communicating with the energy storage element through the second oil supply path; and a first control valve, connected in series with the second oil supply path and signally connected with the controller, and configured to cause the second oil supply path to be in communication or be disconnected according to a control instruction of the controller.

4. The travel stability system according to claim 1, wherein the oil drainage element comprises:

an oil tank, communicating with the energy storage element through the oil drainage path; and a second control valve, connected in series with the oil drainage path and signally connected with the controller, and configured to cause the oil drainage path to be in communication or be disconnected according to a control instruction of the controller.

5. The travel stability system according to claim 1, further comprising:

a third control valve, located in an oil path between the first oil supply path and the energy storage element, and signally connected with the controller, and configured to cause an oil path between the first oil supply path and the energy storage element to be in communication or be disconnected according to a control instruction of the controller.

6. The travel stability system according to claim 1, further comprising:

an electro-hydraulic proportional throttle valve, signally connected with the controller, and configured to change a throttle diameter of the electro-hydraulic proportional throttle valve according to a control instruction of the controller; and a one-way valve, connected in parallel with the electro-hydraulic proportional throttle valve, then arranged in series in the second oil supply path and configured to realize one-way communication in an oil filling direction of the energy storage element.

7. The travel stability system according to claim 6, further comprising:

a road roughness detecting element, signally connected with the controller, and configured to detect a signal characterizing a road roughness of a currently traveled road;

an operation end load detecting element, signally connected with the controller, and configured to detect a current load of the hydraulic actuator; and a database, located within the controller or signally connected with the controller, and configured to store mapping data between a road roughness level and/or a load of the hydraulic actuator and the throttle diameter of the electro-hydraulic proportional throttling valve;

wherein the controller is configured to determine the road roughness level according to the signal characterizing the road roughness of the currently traveled road, and query the database according to the road roughness level and/or the current load of the hydraulic actuator, and then send a control instruction to the electro-hydraulic proportional throttle valve according to a queried throttle diameter of the electro-hydraulic proportional throttle valve, so that the electro-hydraulic proportional throttle valve adjusts the throttle diameter.

8. The travel stability system according to claim 7, further comprising:

a model building unit, signally connected with the database, and configured to take different loads of the hydraulic actuator and different levels of road surface spectrum information as an input, the throttle diameter of the electro-hydraulic proportional throttle valve as an independent variable and travel smoothness as a target function to perform iterative optimization through neural network algorithms, so as to fit a set of curves of an optimal throttling diameter of the electro-hydraulic proportional throttle valve respectively corresponding to different loads of the hydraulic actuator under different road roughness levels, and save fitting data to the database.

9. The travel stability system according to claim 1, wherein the energy storage element comprises:

a first energy storage, having a first maximum operation oil pressure;

a second energy storage, having a second maximum operation oil pressure, wherein the second maximum operation oil pressure is greater than the first maximum operation oil pressure;

a fourth control valve, connected to the second hydraulic oil source, the oil drainage element, the first energy storage and the second energy storage respectively, and configured to switch oil paths from the second hydraulic oil source to the first energy storage or the second energy storage, and switch oil paths from the first energy storage or the second energy storage to the oil drainage element.

10. The travel stability system according to claim 9, wherein the controller is signally connected with the fourth control valve, and configured to determine whether the hydraulic actuator is in an idling condition when the travel stability system is turned on, wherein if the hydraulic actuator is in the idling condition, the controller sends a control instruction to the fourth control valve to switch the fourth control valve to cause the first energy storage to communicate with the first oil supply path via the second oil supply path; and otherwise the controller sends a control instruction to the fourth control valve to switch the fourth control valve to cause the second energy storage to communicate with the first oil supply path via the second oil supply path.

11. The travel stability system according to claim 9, wherein an initial oil pressure of the first energy storage before the travel stability system is turned on is equal to an oil pressure of the hydraulic actuator in an idling condition, and an initial oil pressure of the second energy storage before the travel stability system is turned on is equal to an oil pressure of the hydraulic actuator in a full-load condition.

12. The travel stability system according to claim 1, further comprising:

a speed sensor, signally connected with the controller, and configured to test a speed of a vehicle body where the travel stability system is situated;

wherein the controller is configured to turn on the travel stability system when the speed of the vehicle body where the travel stability system is situated exceeds a preset speed for a preset time period, and disconnect the oil path between the first oil supply path and the energy storage element and turn off the travel stability system when the speed of the vehicle body does not meet a condition that the speed of the vehicle body exceeds the preset speed within the preset time period in a state that the travel stability system is turned on.

13. A backhoe loader, comprising:

a vehicle body; and a travel stability system, which comprises:

a hydraulic actuator;

a first hydraulic oil source, operatively connected with the hydraulic actuator, and configured to provide pressure oil to the hydraulic actuator;

an energy storage element, operatively connected with a first oil supply path between the first hydraulic oil source and the hydraulic actuator;

a controller, configured to compare an oil pressure of the hydraulic actuator with an oil pressure of the energy storage element after the travel stability system is turned on, and achieve a balance between the oil pressure of the energy storage element and the oil pressure of the hydraulic actuator before the energy storage element is accessed to the first oil supply path;

a second hydraulic oil source, operatively connected with the energy storage element, and configured to supply pressure oil to the energy storage element through a second oil supply path so as to raise the oil pressure of the energy storage element; and an oil drainage element, operatively connected with the energy storage element, and configured to unload the energy storage element through an oil drainage path so as to reduce the oil pressure of the energy storage element.

14. The backhoe loader according to claim 13, wherein the hydraulic actuator comprises a boom cylinder.

15. A control method based on a travel stability system, wherein the travel stability system comprises:

a hydraulic actuator;

a first hydraulic oil source, operatively connected with the hydraulic actuator, and configured to provide pressure oil to the hydraulic actuator;

an energy storage element, operatively connected with a first oil supply path between the first hydraulic oil source and the hydraulic actuator;

a controller, configured to compare an oil pressure of the hydraulic actuator with an oil pressure of the energy storage element after the travel stability system is turned on, and achieve a balance between the oil pressure of the energy storage element and the oil pressure of the hydraulic actuator before the energy storage element is accessed to the first oil supply path;

a second hydraulic oil source, operatively connected with the energy storage element, and configured to supply pressure oil to the energy storage element through a second oil supply path so as to raise the oil pressure of the energy storage element; and an oil drainage element, operatively connected with the energy storage element, and configured to unload the energy storage element through an oil drainage path so as to reduce the oil pressure of the energy storage element;

wherein the control method comprises:

comparing the oil pressure of the hydraulic actuator with the oil pressure of the energy storage element after the travel stability system is turned on;

achieving a balance between the oil pressure of the energy storage element and the oil pressure of the hydraulic actuator; and accessing the energy storage element to the first oil supply path.

16. The control method according to claim 15, wherein the step of achieving a balance between the oil pressure of the energy storage element and the oil pressure of the hydraulic actuator comprises:

unloading the energy storage element through an oil drainage path if the oil pressure of the energy storage element is higher than the oil pressure of the hydraulic actuator, so as to reduce the oil pressure of the energy storage element to balance with the oil pressure of the hydraulic actuator; and supplying pressure oil to the energy storage element through the second oil supply path if the oil pressure of the energy storage element is lower than the oil pressure of the hydraulic actuator, so as to raise the oil pressure of the energy storage element to balance with the oil pressure of the hydraulic actuator.

17. The control method according to claim 15, wherein the travel stability system further comprises: a second hydraulic oil source, an electro-hydraulic proportional throttle valve, a one-way valve and a database, wherein the second hydraulic oil source is operatively connected with the energy storage element, and configured to supply pressure oil to the energy storage element through the second oil supply path, the electro-hydraulic proportional throttle valve and the one-way valve which are connected in parallel, are then arranged in series in the second oil supply path, the one-way valve is configured to realize one-way communication in an oil filling direction of the energy storage element, and the electro-hydraulic proportional throttle valve and the database are both signally connected with the controller; the control method further comprising:

detecting a current load of the hydraulic actuator and a signal characterizing road roughness of a current traveled road when the energy storage element is accessed to the first oil supply path;

determining a road roughness level according to the signal characterizing the road roughness of the currently traveled road;

querying the database according to the road roughness level and/or the current load of the hydraulic actuator; and causing the electro-hydraulic proportional throttle valve to adjust the throttle diameter according to the queried throttle diameter of the electro-hydraulic proportional throttle valve.

18. The control method according to claim 17, further comprising:

taking different loads of the hydraulic actuator and different levels of road surface spectrum information as an input, the throttle diameter of the electro-hydraulic proportional throttle valve as an independent variable and travel smoothness as a target function to perform iterative optimization through neural network algorithms, so as to fit a set of curves of an optimal throttling diameter of the electro-hydraulic proportional throttle valve respectively corresponding to different loads of the hydraulic actuator under different road roughness levels, and save fitting data to the database.

19. The control method according to claim 15, wherein the energy storage element comprises: a first energy storage, a second energy storage, and a fourth control valve, wherein a first maximum operation oil pressure of the first energy storage is less than a second maximum operation oil pressure of the second energy storage; the control method further comprises:

determining whether the hydraulic actuator is in an idling condition when the travel stability system is turned on;

switching the fourth control valve to cause the first energy storage to communicate with the first oil supply path if the hydraulic actuator is in the idling condition; and switching the fourth control valve to cause the second energy storage to communicate with the first oil supply path if the hydraulic actuator is in a loaded condition.

* * * * *